United States Patent [19]

König et al.

[11] Patent Number: 4,749,630

[45] Date of Patent: Jun. 7, 1988

[54] COATED HARDMETAL BODY

[75] Inventors: Udo König; Hendrikus van den Berg, both of Essen; Norbert Reiter, Mettmann, all of Fed. Rep. of Germany

[73] Assignee: Fried, Krupp Gesellschaft mit beschrankter Haftung, Essen, Fed. Rep. of Germany

[21] Appl. No.: 881,514

[22] Filed: Jun. 30, 1986

Related U.S. Application Data

[63] Continuation of Ser. No. 646,935, Sep. 4, 1984, abandoned.

[30] Foreign Application Priority Data

Sep. 7, 1983 [DE] Fed. Rep. of Germany ..... 3332260

[51] Int. Cl.[4] ..... B32B 17/06

[52] U.S. Cl. ..... 428/698; 428/699

[58] Field of Search ..... 428/698, 699, 472

[56] References Cited

U.S. PATENT DOCUMENTS

| | | | |
|---|---|---|---|
| 3,189,477 | 6/1965 | Shaffer | 428/698 X |
| 3,261,673 | 7/1966 | Wheildon, Jr. | 29/195 |
| 3,804,034 | 4/1974 | Stiglich, Jr. | 428/698 X |
| 3,837,896 | 9/1974 | Lindstom et al. | 117/70 A |
| 3,955,038 | 5/1976 | Lindstrom et al. | 428/698 X |
| 3,977,061 | 8/1976 | Lindstrom et al. | 428/698 X |
| 4,018,631 | 4/1977 | Hale | 428/698 X |
| 4,019,873 | 4/1977 | Reiter | 428/217 |
| 4,066,821 | 1/1978 | Cook et al. | 428/698 |
| 4,237,184 | 12/1980 | Gonseth et al. | 428/698 X |
| 4,447,263 | 5/1984 | Sugizawa et al. | 428/698 X |

FOREIGN PATENT DOCUMENTS

| | | | |
|---|---|---|---|
| 2233699 | 1/1973 | Fed. Rep. of Germany . | |
| 0154562 | 12/1980 | Japan | 428/698 |
| 0154564 | 12/1980 | Japan | 428/698 |
| 2095702 | 10/1982 | United Kingdom | 428/698 |

OTHER PUBLICATIONS

Zeman, Mayerhofer and Kulmburg, Vorträge des Plansee-Seminars [Lectures at the Plansee Seminars], 1981, pp. 443–457.

Powell et al., (Eds.), *Vapor Deposition,* John Wiley & Sons, Inc., 1966.

*Acta Crystallographica,* vol. B24, 1968, pp. 930–934.

*Primary Examiner*—Nancy A. B. Swisher

*Attorney, Agent, or Firm*—Spencer & Frank

[57] ABSTRACT

A coated hardmetal body comprised of a hardmetal core which contains cobalt as well as tungsten carbide and of an oxygen containing hard substance layer free of binder metal is disclosed whose hardmetal basic body has a zone at its surface which is 0.2 to 20 microns thick and which contains the CoWB phase in addition to the hardmetal components. It is of particular advantage for the binder metal free, oxygen containing hard substance layer to be composed of aluminum oxide, zirconium oxide or aluminum oxynitride. It is further provided that at least one further binder metal free hard substance layer of carbides, nitrides, borides and/or oxides is applied to the binder metal free hard oxide layer. The coated hardmetal body may advantageously be used as a cutting bit for machining metallic workpieces. The coated hardmetal body is produced by gas phase boration and subsequent hard substance coating according to the CVD process.

19 Claims, No Drawings

COATED HARDMETAL BODY

This application is a continuation of application Ser. No. 646,935, filed Sept. 4, 1984, now abandoned.

BACKGROUND OF THE INVENTION

1. Field of the Invention

The present invention relates to a coated hardmetal body comprised of a basic hardmetal body, or core, containing cobalt and tungsten carbide and of a hard substance layer free of binder metal, with the hard substance layer being comprised of hard oxides, a mixture of hard oxides and hard nitrides, or of a mixed crystal of hard oxides and hard nitrides. The present invention further relates to a process for producing the coated hardmetal body herein described.

2. Description of the Related Art

German Patent No. 2,233,699 discloses hardmetal parts which are provided with a coating having a thickness of up to 50 microns of at least one hard, heat resistant compound. The heat resistant compound employed may be a hard oxide, particularly magnesium oxide, hafnium oxide, chromium (III) oxide and/or aluminum oxide, a hard nitride, particularly silicon nitride, vanadium nitride, niobium nitride, aluminum nitride, boron nitride, titanium nitride, zirconium nitride, tantalum nitride and/or hafnium nitride, or a hard boride, particularly titanium diboride, tantalum diboride or hafnium diboride. According to German Patent No. 2,233,699, a coating for a hardmetal body may also be comprised of mixtures or mixed crystals of the above-mentioned hard substances. The hardmetal basic body, or core, of the coated hardmetal body is made of a hardmetal which is composed of a binder metal and of tungsten carbide, titanium carbide, tantalum carbide and/or niobium carbide.

It has been found that the oxygen containing hard substance layers, particularly hard substance layers made of oxides, do not sufficiently adhere to the hardmetal core and chip off under comparatively slight stress. Frequent attempts have been made, therefore, to improve the adhesion of the oxygen containing hard substance layers to the hardmetal core.

Thus, U.S. Pat. No. 3,837,896 discloses a cutting bit made of a hardmetal core, an intermediate layer and a surface layer free of binder metals made of one or a plurality of extremely wear resistant precipitates of aluminum oxide and/or zirconium oxide, wherein the intermediate layer is composed of one or a plurality of carbides and/or nitrides of the elements titanium, zirconium, hafnium, vanadium, niobium, tantalum, chromium, molybdenum, tungsten, silicon and/or boron and is free of binder metals. The binder metal free hard substance intermediate layer composed of carbides and/or nitrides provides a good bond between the oxide surface layer and the hardmetal basic body.

U.S. Pat. No. 4,019,873 discloses a wear resistant shaped body which is comprised of a hardmetal basic body, an intermediate layer of one or a plurality of borides and an outer layer of aluminum oxide and/or zirconium oxide. The boride intermediate layer, which is composed, in particular, of the diborides of the elements titanium, zirconium, hafnium, vanadium, niobium, tantalum, chromium, molybdenum and tungsten, is likewise intended to improve the adhesion of the extremely wear resistant oxide outer hard substance layer.

Finally, U.S. Pat. No. 3,261,673 discloses the application, on a tungsten carbide hardmetal body, of an intermediate nickel layer on top of which an aluminum oxide layer is sprayed, with the nickel intermediate layer providing better adhesion for the aluminum oxide layer and improved heat and corrosion resistance for the compound body.

SUMMARY OF THE INVENTION

It is the object of the present invention to improve the adhesion of oxygen containing, hard substance layers which are free of binder metal on hardmetal bodies, while eliminating the need to apply a separate intermediate layer having a thickness of several microns, as the production of the intermediate layer makes manufacture of the coated hardmetal bodies complicated and expensive.

This object is accomplished by forming a zone on the surface of the hardmetal core having a thickness of from 0.2 to 20 microns which contains, in addition to the components, a CoWB phase. We discovered that extremely good adhesion of the oxygen containing hard substance layers is realized by embedding the CoWB phase in the surface of the hardmetal core.

In addition to good adhesion, the coated hardmetal body according to the present invention exhibits very good wear characteristics.

The present invention also encompasses the application of one or more additional layers of hard substances, each of which is also free of binder metal, the combined thickness of all hard substance layers being from 0.5 to 30 microns.

Another object of the present invention is to provide a method for producing the coated hardmetal body, wherein the CoWB phase is formed in the surface of the hardmetal core by treating the core with a gas mixture of boron trichloride and hydrogen at from 800° to 1200° C. under a pressure of from 5,000 to 100,000 Pascal. The hard substance coating is thereafter deposited from a vapor phase by conventional processes.

DETAILED DESCRIPTION OF THE EMBODIMENTS

The coated hardmetal body of the present invention is comprised of a hardmetal core containing cobalt and tungsten carbide, a CoWB phase formed in the surface zone of the core, and at least one hard substance layer that is free of binder metal.

Our discovery of superior adhesion characteristics and improved wear resistance in coated hardmetal bodies according to this invention was surprising because, in the opinion of persons skilled in the art, the CoWB phase has been believed to worsen the properties of the hard substance coated hardmetal bodies. For example, the publication by Zeman, Mayerhofer and Kulmburg, Vorträge des Plansee-Seminars [Lectures at the Plansee Seminars] 1981, pages 443–457, teaches that the diffusion of boron into the substrate material creates brittle phases because boron preferably reacts with the cobalt binder phase of the hardmetal while forming the CoWB phase. The authors of this reference propose to avoid CoWB formation by applying a titanium carbide intermediate layer onto the hardmetal body before precipitating a titanium diboride hard substance layer. By contrast, when the coated hardmetal body according to the present invention was created, we surprisingly discovered that the CoWB phase extraordinarily improved the adhesion of hard substance layers composed of hard oxides, mixtures of hard oxides and hard nitrides, or mixed crystals of hard oxides and hard nitrides. According to this invention, the application of separate intermediate layers in order to enhance adhesion could advantageously be omitted.

According to the present invention, the binder metal free hard substance layer has a thickness from 0.2 to 20 microns and is composed of aluminum oxide, zirconium oxide or aluminum oxynitride, with the nitrogen content of the aluminum oxynitride being 0.1 to 10 atomic percent. In the context of the invention, "binder metal free" means that no metallic cobalt is present in the coating, in contrast to the basic hardmetal body, in which it forms a constituting element in the order of 3 to 30% by weight. Surprisingly it was found that of the hard substance layers which contain oxides, those containing aluminum oxide, zirconium oxide or aluminum oxynitride, exhibit extremely good adhesion to the surface of the hardmetal core having a CoWB containing zone.

It is further provided, according to the present invention, that at least one additional binder metal free hard substance layer of hard carbides, nitrides, borides and/or oxides of the elements aluminum, silicon, titanium, zirconium, hafnium, vanadium, niobium, tantalum, chromium, molybdenum, tungsten and/or yttrium may be applied to the first binder metal free hard substance layer, with the combined thickness of all hard substance layers being 0.5 to 30 microns. We found that the properties of the hardmetal body according to the present invention can even be improved with the application of at least one additional binder metal free hard substance layer to the binder metal free hard substance layer in contact with the basic hardmetal in which the CoWB phase is embedded. Sandwich-type coatings were found to be particularly suitable, i.e. coatings composed of a plurality of hard substance layers of different compositions.

The process for producing the coated hardmetal body is one in which the hardmetal core is treated to form the CoWB containing zones for 3 to 60 minutes at a temperature from 800° to 1200° C., preferably from 950° to 1050° C., and at a pressure from 5,000 to 100,000 Pascal with a gas mixture of boron trichloride and hydrogen. In the gas mixture, the partial pressure of the boron trichloride is 1 to 10% of the total pressure. By borating the surface of the hardmetal core before applying the actual hard substance coating, reaction of the boron with the cobalt and tungsten carbide contained in the hardmetal results in the formation of the CoWB phase, which is present in the surface zone in addition to the other components of the hardmetal. Although we found a residual content of binder metal was found in the CoWB containing zone, no boron carbide was identified there. Moreover, in the CoWB containing zone up to 66% of the cobalt content of the hardmetal core was converted to the CoWB phase by the reaction with boron. There was, of course, a drop in concentration of the CoWB phase within the zone progressing from exterior toward the interior of the hardmetal core. The CoWB containing zone has a boron content of 0.3 to 3 weight percent, preferably 0.5 to 2 weight percent.

The hardmetal core, provided with a CoWB containing zone, is comprised of a binder metal phase and a hard substance phase. The binder metal phase must contain cobalt and the hard substance phase must contain tungsten carbide. In addition to cobalt, the binder metal phase may also contain the binder metals iron and/or nickel. The hard substance phase may also contain the hard substances titanium carbide, tantalum carbide and/or niobium carbide in addition to the tungsten carbide.

As the boration of the hardmetal core takes only a few minutes, while the application of a hard substance intermediate layer to a thickness of several microns requires several hours, the process according to the present invention brings considerable advantages due to the savings in energy and furnace space. Moreover, the surface boration of the hardmetal core does not change its dimensions; i.e., no boride containing intermediate layer is grown during the boration process.

The binder metal free hard substance layer, and possibly additional binder metal free hard substance layers are coated onto the hardmetal core by precipitation from the gas phase in a known manner according to the CVD process. The CVD process is a method of plating in which the deposits are produced by the reaction of gaseous molecules on a hot surface. Aluminum oxide can be deposited by this method using a gas mixture of an aluminum halide, carbon dioxide and hydrogen. The fundamentals of the CVD technique are described in the book by C. F. Powell, J. H. Oxley and J. M. Blocher, JR. "Vapor deposition", John Wiley & Sons, Inc., New York, London, Sydney 1966.

Because of the good wear properties of the coated hardmetal body, the present invention provides that it be used as a cutting bit for the machining of metallic materials. Its particular suitability for this purpose is shown below.

The subject matter of the present invention will be explained in greater detail with the aid of the following examples.

EXAMPLE 1

Inserts made of a hardmetal of the ISO application group K10, composed of 5.5 weight percent cobalt and 94.5 weight percent tungsten carbide, were introduced into a CVD reactor. After heating the inserts to a temperature of 1010° C., a gas mixture composed of 1.3% boron trichloride and 98.7% hydrogen was conducted through the reactor for 10 minutes at a pressure of 40,000 Pascal. Thereafter, a layer of aluminum oxide of a thickness from 2 to 3 microns was precipitated at the same temperature by conducting a gas mixture of 2.7% aluminum trichloride, 4.3% carbon dioxide, 2.6% hydrogen chloride and 90.4% hydrogen thereover for a time of 150 minutes. The total pressure was 6,000 Pascal. The percentages of the individual substances in the two gas mixtures refer to volume percent and simultaneously indicate the percentage of the partial pressure of the individual substance in the total pressure.

After cooling in flowing hydrogen, the inserts were removed and subjected to various tests. After preparation of a metallographic bevel cut, the borated zone and the applied aluminum oxide layer were examined under a microscope. No chipping of the hard substance layer was found. The hardmetal core composed of tungsten carbide grains and cobalt binder metal exhibited no changes in its structure toward the adjacent aluminum oxide layer. The same results were found by observation of the structure with the aid of a scanning electron microscope. A fine range analysis with the aid of an electron beam microprobe indicated that the surface zone of the hardmetal core contained, in addition to the elements cobalt, tungsten and carbon, about 0.8 weight percent boron, with the concentration of the boron decreasing from the exterior toward the interior. The CoWB containing zone had a thickness of about 3 to 5 microns. Some of the coated plates were examined by way of the X-ray diffraction method. In addition to cobalt, tungsten carbide and aluminum oxide contained in the substrate and in the hard substance layers, this observation indicated numerous further diffraction lines which could all be associated with the known CoWB phase (see Acta Crystallographica, Volume B24, 1968, pages 930–934). Finally, an examination by means of a transmission electron microscope at 50,000 times enlargement, showed that some of the tungsten carbide grains near the surface had been converted to the CoWB phase.

In summary, the test results showed that the process according to the present invention provides a compound body composed of a hardmetal core of tungsten carbide and cobalt which has particles of the CoWB phase embedded in its surface with an aluminum oxide layer firmly adhering thereto.

The coated inserts according to the present invention of the shape SNUN 120408 (according to ISO Standard) were subjected to a cutting edge retention test in which the particularly abrasive spherical graphite cast iron GGG 260 HB (similar to AISI 80/55/06) and alloy chilled cast iron GH HB 500 were worked on a lathe. For a comparison, commercially available inserts of the same geometrical shapes were also tested; these were coated in a known manner with a dual layer of titanium carbide and aluminum oxide.

In the known process according to the U.S. Pat. No. 3,837,896 the inserts were heated in a CVD reactor in pure hydrogen and then held for 30 minutes at 1020° C. in a gas mixture of 8% by volume methane and 92% hydrogen in order to prevent decarburation of the hardmetal body. After this treatment a gas mixture of 2% by volume titaniumtetrachloride, 4% methane and 94% hydrogen was fed into the CVD reactor. The pressure was held at 8,000 Pascal and the temperature at 1020° C. for 300 minutes. After briefly purging with hydrogen the reactives gas mixture for the deposition of the aluminum oxide layer was supplied, using the same parameters as for coating hard metal bodies in which the CoWB-phase is embedded, as mentioned above. By this process a dual layer coating of 5 micron titaniumcarbide and 2 micron aluminum oxide was produced.

Test conditions and results are reflected in the table below:

| | | |
|---|---|---|
| material treated: | spherical graphite cast iron GGG 260 HB | |
| cutting speed: | 90 m/min | |
| cutting depth: | 1.5 mm | |
| feed | 0.2 mm/revolution | |
| cutting time: | 8 minutes | |
| insert | crater wear (μm) | flank wear (mm) |
| comparison body coated with $TiC/Al_2O_3$ total thickness 7 μm TiC = 5 μm (first layer) $Al_2O_3$ = 2 μm (outer layer) | 67 | 0.52 |
| body according to present invention with $Al_2O_3$ coating, total thickness 2 μm | 35 | 0.43 |
| material treated: | alloy chilled cast iron GH HB 500 | |
| cutting speed: | 30 m/min | |
| cutting depth: | 1.5 mm | |
| feed | 0.2 mm/revolution | |
| cutting time: | 8 minutes | |
| | crater wear | flank wear |

-continued

| insert | μm | mm |
|---|---|---|
| comparison body coated with $TiC/Al_2O_3$ total thickness 7 μm TiC = 5 μm (first layer) $Al_2O_3$ = 2 μm (outer layer) | (broke after 7.5 minutes of testing) | |
| body according to present invention with $Al_2O_3$ coating, total thickness 2 μm | 21 | 0.20 |

The magnitude of wear was determined in a known manner by measuring the crater wear and the flank wear. It was found that the compound bodies according to the invention exhibited very little wear in spite of the smaller total thickness of the hard substance coating.

EXAMPLE 2

Inserts of ISO application group M15 were used for the coating process; in addition to cobalt as binder metal and tungsten carbide as a hard substance, they also contained a cubic mixed carbide of the composition (W, Ti, Ta, Nb)C with a lattice constant of a=0.436 nm. Following the treatment outlined in Example 1 in a boron trichloride-hydrogen gas mixture, a layer of aluminium oxinitride of about 1 micron in thickness was precipitated by the CVD process. In addition to its major components of aluminum and oxygen, this substance also contained about 1 weight percent nitrogen. This was achieved by adding 14% by volume nitrogen to the gas mixture of aluminum chloride, carbon dioxide, hydrogen chloride and hydrogen. Then, a titanium nitride layer of about 0.25 microns in thickness was precipitated in a known manner onto the aluminum oxynitride layer using a gas mixture of titanium tetrachloride, nitrogen and hydrogen. Immediately thereafter, three further aluminum oxynitride layers of about 1 micron in thickness and three further titanium nitride layers of about 0.25 micron in thickness were alternatingly precipitated thereon forming a compound body which had the following layer structure:

Hardmetal with a CoWB bearing zone-aluminum oxynitride-titanium nitride-aluminum oxynitride-titanium nitride-aluminum oxynitride-titanium nitride-aluminum oxynitride-titanium nitride. The total thickness of the hard substance coating was about 4 to 5 microns and the CoWB containing zone had a depth from 3 to 5 microns.

The inserts were examined according to the same method as described in Example 1. The CoWB phase was again found in the surface zone of the hardmetal. The X-ray diffraction diagram showed diffraction lines of the following phases: cobalt, tungsten carbide, mixed carbide, CoWB, aluminum oxynitride and titanium nitride. By way of electron diffraction, very small percentages were also detected of a $W_2Co_{21}B_6$ phase, which presumably was created as an intermediate stage in the formation of the CoWB phase. Additional phases, such as boron carbide, titanium diboride and titanium carbide, could not be found. Thus the analyses indicated that the compound body made of a mixed carbide containing hardmetal with CoWB components embedded near the surface was comprised of four successive aluminum oxynitride layers that were separated by thin titanium nitride layers and were finished on their outer surface by another thin titanium nitride layer. The layer bordering on the borated hard metal was an aluminum oxynitride layer.

Turning tests were then run with inserts of the form SNUN 120408, with the following results:

| | | |
|---|---|---|
| material worked: | standard annealed steel C60N | |
| cutting speed: | 240 m/minute | |
| cutting depth: | 1.5 mm | |
| feed | 0.28 mm/revolution | |
| cutting time: | 10 minutes | |
| inserts | crater wear (μm) | flank wear (mm) |
| comparison element hardmetal core MIS (inner layer) coated with 5 μm TiC + 3 μm $Al_2O_3$ (intermediate layer) + 0,5 μm TiN (outer layer) total thickness 8,5 μm | 102 | 0.22 |
| element according to present invention, Example 2 with 4 AlON layers and 4 TiN layers | | |
| Sample 1, total layer thickness 5 μm | 29 | 0.23 |
| Sample 2, total layer thickness 4 μm | 40 | 0.22 |

Although the commercially available insert according to the prior art had a significantly greater total layer thickness than the insert according to the present invention, the latter exhibited considerably less wear due to cratering.

The embodiments presented herein are provided for the purpose of illustrating but not limiting the coated body and the process for its manufacture. It will be understood that the invention is intended to include the many equivalent modifications and variations that may be made within the scope of the following claims.

We claim:

1. A coated hardmetal body, comprising a hardmetal core and at least one binder metal free hard substance layer, wherein the hardmetal core comprises cobalt and tungsten carbide and the binder metal free hard substance layer consists of one or more hard oxides, a mixture of one or more hard oxides and one or more hard nitrides, or mixed crystals of one or more hard oxides and one or more hard nitrides; characterized in that the hardmetal core has a zone at its surface which is 0.2 to 20 microns thick and consists essentially of, in addition to the components of the hardmetal core, a CoWB phase, which CoWB phase is present as particles of CoWB embedded in the surface zone of the hardmetal core, wherein the binder metal free hard substance layer contacts the components of the hardmetal core including cobalt and tungsten carbide and particles of the CoWB phase at the surface of the hardmetal core.

2. The coated hardmetal body as defined in claim 1, wherein the hard substance layer has a thickness of 0.2 to 20 microns and consists of one or more hard substances selected from the group consisting of aluminum oxide, zirconium oxide and aluminum oxynitride, wherein the nitrogen content of the aluminum oxynitride is from 0.1 to 10 atomic percent.

3. The coated hardmetal body as defined in claim 1, wherein at least one additional binder metal free hard substance layer of one or more hard substances selected from the group consisting of carbides, nitrides, borides and oxides of one or more elements selected from the group consisting of aluminum, silicon, titanium, zirconium, hafnium, vanadium, niobium, tantalum, chromium, molybdenum, tungsten and yttrium, is applied to the binder metal free hard substance layer, and wherein the thickness of the hard substance layers combined is from 0.5 to 30 microns.

4. The coated hardmetal body as defined in claim 1 comprising a cutting bit for machining metallic materials.

5. The coated hardmetal body as defined in claim 2 comprising a cutting bit for machining metallic materials.

6. The coated hardmetal body as defined in claim 3 comprising a cutting bit for machining metallic materials.

7. A coated hardmetal body, comprising a hardmetal core and at least one binder-metal-free hard substance layer, wherein the hardmetal core comprises cobalt and tungsten carbide and the binder-metal-free hard substance layer consists of one or more hard oxides, a mixture of one or more hard oxides and one or more hard nitrides, or mixed crystals of one or more hard oxides and one or more hard nitrides; characterized in that the hardmetal core has a zone at its surface which is 0.2 to 20 microns thick and consists essentially of, in addition to the components of the hardmetal core, a CoWB phase, which CoWB phase is present as particles of CoWB embedded in the surface zone of the hardmetal core, wherein the binder metal free hard substance layer contacts the components of the hardmetal core including cobalt and tungsten carbide and particles of the CoWB phase at the surface of the hardmetal core, and wherein the coated hardmetal body is produced by a process comprising:

treating the hardmetal core with a gas mixture of boron trichloride and hydrogen for from 3 to 60 minutes, at a temperature ranging from 800° to 1200° C., and at a pressure ranging from 5,000 to 100,000 Pascal to form the CoWB phase, wherein the partial pressure of the boron trichloride ranges from 1 to 10% of the total pressure; and precipitating thereafter at least one binder-metal-free hard substance layer from a vapor phase.

8. The coated hardmetal body according to claim 7, wherein the hardmetal core is treated with the gas mixture of boron trichloride and hydrogen at a temperature ranging from 950° C. to 1050° C.

9. The coated hardmetal body according to claim 7, wherein the zone containing the CoWB phase has a thickness ranging from 0.2 to 20 microns.

10. The coated hardmetal body according to claim 7, wherein a single layer of hard substances is precipitated which has a thickness ranging from 0.2 to 20 microns.

11. The coated hardmetal body according to claim 7, wherein each said at least one binder-metal-free hard substance layer consists of one or more hard substance selected from the group consisting of hard carbides, nitrides, borides and oxides of one or more elements selected from the group consisting of aluminum, silicon, titanium, zirconium, hafnium, vanadium, niobium, tantalum, chromium, molybdenum, tungsten and yttrium.

12. The coated hardmetal body according to claim 11, wherein the total thickness of all hard substance layers ranges from 0.5 to 30 microns.

13. A process for producing a coated hardmetal body comprising a hardmetal core comprised of cobalt and tungsten carbide and having a CoWB phase in the surface zone thereof coated with at least one binder metal free hard substance layer, comprising; treating the hard metal core with a gas mixture of boron trichloride and hydrogen for 3 to 60 minutes at a temperature of from 800° to 1200° C., and at a pressure from 5,000 to 100,000 Pascal to form a CoWB containing zone at the surface of the hardmetal core; wherein the partial pressure of the boron trichloride is 1 to 10% of the total pressure, and thereafter precipitating at least one binder metal free hard substance layer from a vapor phase.

14. The process of claim 13, wherein the hardmetal core is treated with the gas mixture of boron trichloride and hydrogen at a temperature of from 950° C. to 1050° C.

15. The process of claim 13, wherein the CoWB containing zone has a thickness of from 0.2 to 20 microns.

16. The process of claim 13, wherein the binder metal free hard substance layer consists of one or more hard substances selected from the group consisting of hard oxides, a mixture of hard oxides and hard nitrides, and mixed crystals of hard oxides and hard nitrides.

17. The process of claim 16, wherein a single layer of hard substances is precipitated which has a thickness of from 0.2 to 20 microns.

18. The process of claim 16, wherein one or more additional binder metal free hard substance layers is precipitated onto the coated hardmetal core, said layer consisting of one or more hard substances selected from the group consisting of hard carbides, nitrides, borides and oxides of one or more elements selected from the group consisting of aluminum, silicon, titanium, zirconium, hafnium, vanadium, niobium, tantalum, chromium, molybdenum, tungsten and yttrium.

19. The process of claim 18, wherein the thickness of all hard substance layers is from 0.5 to 30 microns.

* * * * *